US007018525B2

(12) United States Patent
Miller et al.

(10) Patent No.: US 7,018,525 B2
(45) Date of Patent: Mar. 28, 2006

(54) PROCESSES FOR PRODUCING LUBRICANT BASE OILS WITH OPTIMIZED BRANCHING

(75) Inventors: Stephen J. Miller, San Francisco, CA (US); Dennis J. O'Rear, Petaluma, CA (US); John Rosenbaum, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 10/684,554

(22) Filed: Oct. 14, 2003

(65) Prior Publication Data

US 2005/0077209 A1 Apr. 14, 2005

(51) Int. Cl.
*C10G 73/38* (2006.01)
*C10G 67/04* (2006.01)

(52) U.S. Cl. ..... 208/27; 208/28; 208/33; 208/95; 208/96

(58) Field of Classification Search ..... 208/27, 208/28, 33, 95, 96
See application file for complete search history.

(56) References Cited

U.S. PATENT DOCUMENTS

| | | | | |
|---|---|---|---|---|
| 3,773,650 | A | 11/1973 | Hislop et al. | |
| 3,775,288 | A | 11/1973 | Eagen et al. | |
| 3,852,207 | A | 12/1974 | Stangeland et al. | |
| 3,904,513 | A | 9/1975 | Fischer et al. | |
| 4,157,294 | A | 6/1979 | Iwao et al. | |
| 4,440,871 | A | 4/1984 | Lok et al. | |
| 4,477,333 | A | 10/1984 | Hafez | |
| 4,568,663 | A | 2/1986 | Mauldin | |
| 4,941,981 | A | 7/1990 | Perricone et al. | |
| 4,943,424 | A | 7/1990 | Miller | |
| 4,975,177 | A * | 12/1990 | Garwood et al. | 208/27 |
| 5,059,299 | A | 10/1991 | Cody et al. | |
| 5,096,883 | A | 3/1992 | Mercer et al. | |
| 5,135,638 | A | 8/1992 | Miller | |
| 5,158,665 | A | 10/1992 | Miller | |
| 5,189,012 | A | 2/1993 | Patel et al. | |
| 5,282,958 | A | 2/1994 | Santilli et al. | |
| 5,413,695 | A | 5/1995 | Miller | |
| 5,885,438 | A * | 3/1999 | Apelian et al. | 208/27 |
| 6,008,164 | A | 12/1999 | Aldrich et al. | |
| 6,059,955 | A | 5/2000 | Cody et al. | |
| 6,090,986 | A | 7/2000 | Godwin et al. | |
| 6,090,989 | A | 7/2000 | Trewella et al. | |
| 6,096,940 | A | 8/2000 | Wittenbrink et al. | |
| 6,190,532 | B1 * | 2/2001 | Degnan et al. | 208/27 |
| 6,506,297 | B1 | 1/2003 | Wittenbrink et al. | |
| 6,663,768 | B1 | 12/2003 | Miller | |

FOREIGN PATENT DOCUMENTS

| | | |
|---|---|---|
| EP | 0609079 | 8/1994 |
| EP | 0776959 A2 | 3/1998 |
| EP | 0668342 B1 | 8/1999 |
| EP | 1354931 | 11/2003 |
| GB | 2384246 | 7/2003 |
| WO | WO 99/20720 | 4/1999 |
| WO | WO 99/41332 | 8/1999 |
| WO | WO 99/45085 | 9/1999 |
| WO | WO 00/14179 | 3/2000 |
| WO | WO 00/14183 | 3/2000 |
| WO | WO 00/14187 | 3/2000 |
| WO | WO 00/14188 | 3/2000 |
| WO | WO 00/18156 | 3/2000 |
| WO | WO 02/46333 | 6/2002 |
| WO | 2004/053030 | 6/2004 |
| WO | 2004/113475 | 12/2004 |

OTHER PUBLICATIONS

U.S. Appl No. 10/682,965, Miller et al., filed Oct. 14, 2003, "Lubricant Base Oils with Optimized Branching".
API Project 42, America Petroleum Institute Research Project 42 at Penn State College(1943-1946).
Kramer, D.C., et al., "Influence of Group II & III Base Oil Composition on VII and Oxidation Stability", AIChE Spring National Meeting in Houston (1999).
United Kingdom Search Report dated Feb. 21, 2005.
Netherlands Search Report dated Jul. 20, 2005.

* cited by examiner

*Primary Examiner*—Walter D. Griffin
(74) *Attorney, Agent, or Firm*—Buchanan Ingersoll PC

(57) ABSTRACT

This invention relates to processes of producing lubricant base oils comprising paraffinic hydrocarbon components that have optimized branching. The lubricant base oils comprising paraffinic hydrocarbon components with optimized branching have low amounts of branching with the branching concentrated toward the center of the lubricant base oil molecules. The lubricant base oils comprising paraffinic hydrocarbon components with optimized branching have low pour points and extremely high viscosity indexes. The invention further relates to processes of producing commercial lubricants comprising the lubricant base oils comprising paraffinic hydrocarbon components with optimized branching from waxy feeds.

32 Claims, 1 Drawing Sheet

FIGURE
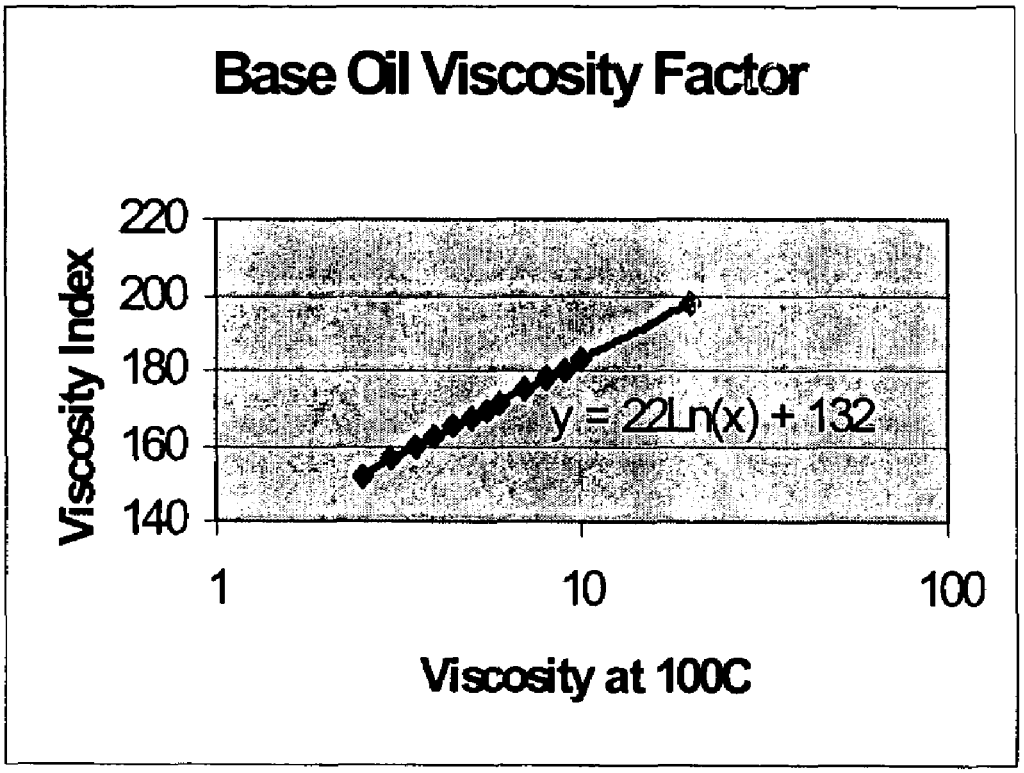

PROCESSES FOR PRODUCING LUBRICANT BASE OILS WITH OPTIMIZED BRANCHING

FIELD OF THE INVENTION

This invention relates to processes of producing lubricant base oils comprising paraffinic components that have optimized branching. The lubricant base oils comprising paraffinic components with optimized branching have low amounts of branching with the branching concentrated toward the center of the lubricant base oil molecules. The lubricant base oils, comprising paraffinic components with optimized branching, have low pour points and extremely high viscosity indexes. The invention further relates to processes of producing commercial lubricants comprising the lubricant base oils comprising paraffinic components with optimized branching.

BACKGROUND OF THE INVENTION

High quality lubricants should be, and generally are, paraffinic in nature, since paraffins have a high viscosity index. However, normal paraffins, in particular, are waxy in character, and contribute to a high pour point in the oil. Accordingly, waxy paraffinic feeds may be converted to lubricant base oils by hydroisomerization dewaxing, which creates branching on the paraffinic molecules. Hydroisomerization dewaxing typically produces a lubricant base oil having relatively high branching. While creating branching on waxy paraffinic molecules generally lowers the pour point, it also lowers the viscosity Index (VI). High amounts of branching are required with an all-hydroisomerization process to reach target pour and cloud points. Accordingly, the products resulting from hydroisomerization processes typically have less than optimal viscosity indexes due to the relatively high amount of branching. Lubricant base oil products produced by a hydroisomerization process may have branching characteristics similar to those products described in U.S. Pat. Nos. 6,096,940, 6,090,989, and 6,059,955.

Low pour points are desirable in lubricant base oils. A low pour point indicates that a lubricant base oil will flow and lubricate at low temperatures. Pour point is a measurement of the temperature at which the sample will begin to flow under carefully controlled conditions. Pour point may be determined as described in ASTM D 5950. Many commercial lubricant base oils have specifications for pour point. When lubricant base oils have low pour points, they also are likely to have other good low temperature properties, such as low cloud point, low cold filter plugging point, and low temperature cranking viscosity.

Lubricant base oils having pour-cloud point spreads below about 30° C. are also desirable. Higher pour-cloud point spreads require processing the lubricant base oil to very low pour points in order to meet cloud point specifications.

It is further desired to have lubricant base oils having high viscosity indexes. Viscosity Index (VI) is an empirical, unitless number indicating the effect of temperature change on the kinematic viscosity of the oil. Liquids change viscosity with temperature, becoming less viscous when heated; the higher the VI of an oil, the lower its tendency to change viscosity with temperature. High VI lubricants are needed wherever relatively constant viscosity is required at widely varying temperatures. For example, in an automobile, engine oil must flow freely enough to permit cold starting, but must be viscous enough after warm-up to provide full lubrication. VI may be determined as described in ASTM D 2270-93.

Pour point and VI can be linked to the branching on the paraffinic hydrocarbon molecules of the lubricant base oil. Creating branching on linear paraffinic hydrocarbons generally lowers the pour point and lowers the viscosity Index (VI). The VI tends to decrease sharply if the number of substitutions of equal length is doubled, but the pour point may be less affected. API Project 42 data (Research completed between Jul. 1, 1943 and Jul. 1, 1946 by American Petroleum Institute Research Project 42 at the Pennsylvania State College) showed that VI declined as branches were moved to the middle of the molecule for butyl, phenyl, and cyclohexyl branches on a linear paraffin.

Waxy hydrocarbons prepared from a Fischer Tropsch process are a good potential feedstock for preparing high quality lubricants. Advantageously, the Fischer Tropsch products contain little, if any, of typical petroleum contaminants, such as aromatic compounds, sulfur compounds, and nitrogen compounds. However, the initial Fischer Tropsch waxy paraffins are generally straight chain waxes. Accordingly, the Fischer Tropsch products need to be subjected to further processing or upgrading to provide high quality lubricant base oil stocks.

Many researchers have investigated ways of converting waxy feeds, in particular waxy feeds from Fischer-Tropsch synthesis processes, into lubricant base oil stocks. By way of example, in an attempt to create enough branching to lower the pour point but not excessive branching such that the VI is significantly decreased, prior art methods have used a combination of hydroisomerization with solvent dewaxing using amorphous or large pore zeolite catalysts (e.g. Beta zeolite) for the hydroisomerization step. Nonetheless, in prior art methods using this technique, considerable branching is still created.

By way of example, U.S. Pat. No. 6,090,989 discloses a hydrodewaxing process to make lubricant oil basestocks. The lubricant oil basestocks as disclosed therein contain paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2$>4), are such that: (a) BI−0.5($CH_2$>4) of greater than 15 and (b) BI+0.85($CH_2$>4)<45. This calculation means that for a molecule containing 24 carbons, that molecule would have at least 2.5 branches per molecule, or for every 100 carbons there are greater than about 9 branches.

U.S. Pat. No. 6,008,164 discloses a method for producing a lubricant base stock from a Fischer Tropsch wax wherein the lubricant base stock has a preselected oxidative stability. The lubricant base oils are disclosed as containing a mixture of branched paraffins wherein the branched paraffins contain up to four alkyl branches and wherein the free carbon index (FCI) of the branched paraffins is at least about 3. The Examples of the '164 patent demonstrate lubricant base oils with 3.46, 3.14, 4.19, and 3.59 branches per molecule.

WO 99/45085 discloses an integrated process for preparing a lubricant oil base stock including an isomerization step followed by a solvent dewaxing step. In the process a waxy feed as disclosed therein, a waxy feed is isomerized to an intermediate pour point over a select molecular sieve and the isomerized oil is then solvent dewaxed. The lubricant oil base stocks obtained were disclosed as having viscosity indexes of greater than about 140. The Examples of the '085 publication demonstrate lubricant oil base stocks with viscosity indexes in the 140's with the highest being 156.

EP 0776959 A2 discloses a process for preparing lubricant base oils having a VI of at least 150 from a Fischer Tropsch wax feed comprising contacting the Fischer Tropsch wax feed with a hydroconversion catalyst under hydroconversion conditions; separating the hydroconverted effluent obtained into at least one lighter fraction and a heavy fraction; and dewaxing the heavy fraction to yield the base oil. The feed to the process is narrowly limited to a Fischer-Tropsch wax having a congealing point of at least 50° C. and has a boiling range where the difference between the 90% wt boiling point and the 10% wt boiling point is in the range of from 40 to 150° C. The hydroconversion catalysts are disclosed as being amorphous catalysts.

U.S. Pat. No. 6,096,940 discloses a process for producing a biodegradable hydrocarbon lubricant base oil. The process comprises contacting a 700° F.+ Fischer Tropsch wax feed with hydrogen over a bifunctional non-noble Group VIII metal catalyst to produce hydroisomerization and hydrocracking reactions at 700° F.+ conversion levels ranging from about 20 to about 50 percent on a once through basis, based on the weight of 700° F.+ feed converted to 700° F.− materials, to produce a $C_5$-1050° F. crude fraction. The isoparaffins contained in the crude fraction are disclosed as having methyl branches in an amount of less than about 7.5 methyl branches per 100 carbons. From the $C_5$-1050° F. fraction, a residual fraction having an initial boiling point ranging from about 650° F. to about 750° F. is recovered. The residual fraction is dewaxed and a dewaxed oil is recovered. From the dewaxed oil a biodegradable hydrocarbon base oil is recovered. In the Examples, the VI of the recovered lubricant base oil is in the 130's and 140's.

U.S. Pat. No. 5,059,299 discloses a process for maximizing the yield of lubricant oil base stocks having pour points of about −21° C. or lower and a viscosity index of about 130 and higher by the steps of 1) isomerizing the wax over an isomerization catalyst such that between about 15 to 30% unconverted wax remains in the oil fraction of the isomerate boiling in the lube boiling range, 2) fractionating the product, 3) solvent dewaxing the fraction boiling in the lube boiling range to a pour/filter delta T (the difference in temperature between the pour point of the dewaxed oil and the filter temperature) of 9° C. or less, and 4) recovering a dewaxed lube oil product. The dewaxing catalysts suitable for use in this invention are defined broadly and include catalysts such as fluorided alumina.

There has also been research into how to analyze the composition of lubricant base oils and how the properties of lubricant base oils are influenced by its composition. By way of example a publication by Kramer, D. C., et al, "Influence of Group II & III Base Oil Composition on VI and Oxidation Stability," prepared for presentation at the 1999 AIChE Spring National Meeting in Houston, Mar. 16, 1999 teaches that field ionization mass spectrometry (FIMS) is especially valuable in determining the distribution of paraffins and naphthenes in Group II and III base oils. Below 1% aromatics, the authors found that the most effective way to further improve oxidation stability was to increase VI. In general, the authors found that the lower the concentration of polycyclic naphthenes in an oil, the higher its VI and its oxidation stability.

There remains a need for an efficient and economical process for converting waxy paraffinic feeds to high quality lubricant base oils, in particular lubricant base oils with good low temperature properties and high viscosity indexes.

SUMMARY OF THE INVENTION

The present invention relates to a process of making a lubricant base oil. The process comprises hydroisomerization dewaxing a waxy feed using a shape selective intermediate pore size molecular sieve to produce an intermediate oil isomerate, wherein the intermediate oil isomerate comprises paraffinic hydrocarbon components in which the extent of branching is less than 7 alkyl branches per 100 carbons. In the process, the intermediate oil isomerate is solvent dewaxed to produce a lubricant base oil. The lubricant base oil produced comprises paraffinic hydrocarbon components in which the extent of branching is less than 8 alkyl branches per 100 carbons and less than 20 wt % of the alkyl branches are at the 2 position; the lubricant base oil having a pour point of less than −8° C.; a kinematic viscosity at 100° C. of about 3.2 cSt or greater; and a Viscosity Index greater than a Target Viscosity Index as calculated by the following equation:

$$\text{Target Viscosity Index}=22\times\ln(\text{Kinematic Viscosity at } 100^\circ\text{ C.})+132.$$

In another aspect, the present invention relates to a process of making a lubricant base oil comprising performing Fischer-Tropsch synthesis on syngas to provide a product stream and isolating a waxy hydrocarbon feed stream. The waxy hydrocarbon feed stream is subjected to hydroisomerization dewaxing using a shape selective intermediate pore size molecular sieve to form an intermediate oil isomerate, wherein the intermediate oil isomerate comprises paraffinic hydrocarbon components in which the extent of branching is less than 7 alkyl branches per 100 carbons. The intermediate oil isomerate is solvent dewaxed to produce a lubricant base oil. The lubricant base oil produced comprises paraffinic hydrocarbon components in which the extent of branching is less than 8 alkyl branches per 100 carbons and less than 20 wt % of the alkyl branches are at the 2 position; the lubricant base oil having a pour point of less than −8° C.; a kinematic viscosity at 100° C. of about 3.2 cSt or greater; and a Viscosity Index greater than a Target Viscosity Index as calculated by the following equation:

$$\text{Target Viscosity Index}=22\times\ln(\text{Kinematic Viscosity at } 100^\circ\text{ C.})+132.$$

In yet another aspect, the present invention relates to a process for manufacturing a finished lubricant. In the process a waxy feed is subjected to hydroisomerization dewaxing using a shape selective intermediate pore size molecular sieve to produce an intermediate oil isomerate, wherein the intermediate oil isomerate comprises paraffinic hydrocarbon components in which the extent of branching is less than 7 alkyl branches per 100 carbons. The intermediate oil isomerate is solvent dewaxed to produce a lubricant base oil. The lubricant base oil produced comprises paraffinic hydrocarbon components in which the extent of branching is less than 8 alkyl branches per 100 carbons and less than 20 wt % of the alkyl branches are at the 2 position; the lubricant base oil having a pour point of less than −8° C.; a kinematic viscosity at 100° C. of about 3.2 cSt or greater; and a Viscosity Index greater than a Target Viscosity Index as calculated by the following equation:

$$\text{Target Viscosity Index}=22\times\ln(\text{Kinematic Viscosity at } 100^\circ\text{ C.})+132.$$

The lubricant base oil is blended with one or more lubricant additives to provide a finished lubricant.

In a further aspect, the present invention relates to a process of making a lubricant base oil comprising performing Fischer-Tropsch synthesis on syngas to provide a product stream and isolating a waxy hydrocarbon feed stream. The waxy hydrocarbon feed stream is subjected to hydroisomerization dewaxing using a shape selective intermediate pore size molecular sieve to form an intermediate oil isomerate. The intermediate oil isomerate is subjected to solvent dewaxing to produce a lubricant base oil wherein the lubricant oil has a pour point of less than − 8° C.; a kinematic viscosity at 100° C. of greater than 3.2 cSt; and a Viscosity Index greater than a Target Viscosity Index as calculated by the following equation:

Target Viscosity Index=22×ln(Kinematic Viscosity at 100° C.)+132.

BRIEF DESCRIPTION OF THE DRAWINGS

FIGURE illustrates the plot of Viscosity at 100° C. vs Viscosity Index providing the equation for calculation of the Target Viscosity Index:

Target Viscosity Index=22×ln(Kinematic Viscosity at 100° C.)+132 wherein ln(Kinematic Viscosity at 100° C.) is the natural logarithm of Kinematic Viscosity at 100° C.

DETAILED DESCRIPTION OF ILLUSTRATIVE EMBODIMENTS

The present invention relates to processes of producing lubricant base oils, comprising a mixture of paraffinic hydrocarbon components wherein the mixture of paraffinic hydrocarbon components have optimized branching, from waxy feeds. These lubricant base oils comprising a mixture of paraffinic hydrocarbon components with optimized branching have low amounts of branching overall with the branching concentrated toward the center of the lubricant base oil molecules. The present invention also relates to these lubricant base oils comprising a mixture of paraffinic hydrocarbon components with optimized branching and commercial finished lubricants comprising these lubricant base oils. The present invention further relates to processes of producing the finished lubricants comprising the lubricant base oils comprising a mixture of paraffinic hydrocarbon components with optimized branching.

It has been surprisingly discovered that in lubricant base oils with kinematic viscosities greater than about 3.2 cSt at 100° C., optimizing branching can provide exceptionally low pour points and extremely high viscosity indexes, that are greater than the Target Viscosity Index, as defined herein. Optimizing branching according to the present invention means that the lubricant base oil molecules comprise paraffinic hydrocarbon components having low amounts of branching overall with the branching concentrated toward the center of the molecules.

Lubricant base oils comprising paraffinic hydrocarbon components with optimized branching and having kinematic viscosities greater than about 3.2 cSt at 100° C. can be produced by a combination of a mild hydroisomerization followed by solvent dewaxing. According to the present invention, a waxy feed is subjected to a mild hydroisomerization process under conditions such that an intermediate oil isomerate comprising paraffinic hydrocarbon components having specific branching properties is formed. The intermediate oil isomerate is then subjected to solvent dewaxing under conditions to provide a lubricant base oil comprising paraffinic hydrocarbon components with optimized branching and having a kinematic viscosity greater than about 3.2 cSt at 100° C. The process of the present invention results in a lubricant base oil comprising paraffinic hydrocarbon components with optimized branching such that there are low amounts of branching overall with the branching concentrated toward the center of the molecules. The extent of branching and branching position can be determined by NMR Analysis.

It has been surprisingly discovered that minimizing the overall branching while maximizing the branching toward the middle of the lubricant base oil molecules provides a lubricant base oil with exceptionally high viscosity indexes and low pour points. Accordingly, high quality lubricant base oils with exceptionally high viscosity indexes and low pour points are produced.

Definitions

The following terms will be used throughout the specification and will have the following meanings unless otherwise indicated.

"Derived from a Fischer-Tropsch synthesis or process" means that the fraction, steam, or product in question originates from or is produced at some stage by a Fischer-Tropsch process.

"Waxy hydrocarbon feedstock" is a feed or stream comprising molecules with a carbon number of $C_{20+}$ and having a boiling point generally above about 600° F. (316° C.). The waxy hydrocarbon feedstocks useful in the processes disclosed herein may be synthetic waxy feedstocks, such as Fischer Tropsch waxy hydrocarbons, or may be derived from natural sources, such as petroleum waxes.

"Lubricant base oil" means a fraction or product meeting specifications for a lubricant base oil. Lubricant base oil fractions are provided according to the processes of the present invention by a hydroisomeration/solvent dewaxing process and have optimized branching properties. Additional properties of the lubricant base oils provided according to the present invention include initial boiling points in the range of 600 to 950° F., end boiling points in the range of 800 to 1200° F., viscosities in the range of 3.2 to 20 cSt at 100° C., viscosity indices in the range of 158 to 240, preferably in the range of 163 to 220, and more preferably in the range of 165 to 200. The lubricant base oils further have pour points less then −8° C., preferably less than −9° C., more preferably ≦−15° C., and even more preferably less than −15° C., and preferably in the range of −8 to −35° C. The lubricant base oils may also have cloud points in the range of +5 to −20° C.

"Hydrocarbon or hydrocarbonaceous" means a compound or substance that contains hydrogen and carbon atoms, which may also include heteroatoms such as oxygen, sulfur or nitrogen.

"Target Viscosity Index" is an empirical number derived from kinematic viscosity and Viscosity Index. The Target Viscosity Index is calculated by the following equation:

Target Viscosity Index=22×ln(Kinematic Viscosity at 100° C.)+132 wherein ln(Kinematic Viscosity at 100° C.) is the natural logarithm of Kinematic Viscosity at 100° C. The determination of Target Viscosity Index is illustrated in the FIGURE.

"Alkyl" means a linear saturated monovalent hydrocarbon radical of one to six carbon atoms or a branched saturated monovalent hydrocarbon radical of three to eight carbon atoms. Preferably, the alkyl groups are methyl. Examples of alkyl groups include, but are not limited to, groups such as methyl, ethyl, n-propyl, isopropyl, n-butyl, isobutyl, sec-butyl, t-butyl, n-pentyl, and the like.

"Free Carbon Index" (FCI) is a measure of the number of carbon atoms in an isoparaffin that are located at least 5 carbons from a terminal carbon and 4 carbons away from a side chain.

It has been surprisingly discovered that lubricant base oils with kinematic viscosities greater than about 3.2 cSt at 100° C. comprising paraffinic hydrocarbon components having certain desired branching properties (optimized branching) have extremely high viscosity indexes and excellent low pour points. The Viscosity Indexes of the lubricant base oils of the present invention are greater than the Target Viscosity Index of the oil. Preferably, the viscosity indexes of the lubricant base oils of the present invention are greater than the Target Viscosity Index of the oil plus 5. As defined above, the Target Viscosity Index is viscosity dependent and is calculated by the following equation:

$$\text{Target Viscosity Index} = 22 \times \ln(\text{Kinematic Viscosity at } 100^\circ\text{ C.}) + 132.$$

These lubricant base oils comprise a mixture of paraffinic hydrocarbon components wherein the overall mixture of paraffinic hydrocarbon components have optimized branching. These lubricant base oils comprising paraffinic hydrocarbon components with optimized branching are produced from waxy feeds. The present invention also relates to intermediate oil isomerates made in the processes of making the lubricant base oils of the present invention. The intermediate oil isomerates of the present invention comprising paraffinic hydrocarbon components having specific branching properties. Accordingly, when the intermediate isomerates are converted to lubricant base oils, the lubricant base oils comprise paraffinic hydrocarbon components having optimized branching properties. The intermediate oil isomerates are comprised of paraffinic hydrocarbon components in which the paraffinic hydrocarbon components have low amounts of branching overall.

The intermediate oil isomerates are converted into lubricant base oils comprised of paraffinic hydrocarbon components having optimized branching properties. Optimizing branching properties according to the present invention means that the paraffinic hydrocarbon components have low amounts of branching overall with the branching concentrated toward the center of the molecules. Accordingly, the branching toward the ends of the molecules is minimized.

The branches on the paraffinic hydrocarbon components of the lubricant base oils and intermediate oil isomerates are alkyl branches. In the lubricant base oils and intermediate oil isomerates, the alkyl branches are predominantly methyl branches (—$CH_3$). According to the present invention in the lubricant base oils, the branching properties are optimized. The branching properties include the extent of branching and the position of branching. The extent of branching can be measured by the number of alkyl branches per a given number of carbons of the paraffinic hydrocarbon components. Preferably, the extent of branching is measured by the number of alkyl branches per 100 carbons. The position of branching is measured relative to the ends of the hydrocarbon chain of the paraffin, with the terminal carbons being the 1 position, the next-in adjacent carbon being the 2 position, the subsequent-in carbon being the 3 position, and so forth until the center of the hydrocarbon chain is reached. The positions on the hydrocarbon chain may be illustrated as follows:

$$\underset{1}{CH_3}-\underset{2}{CH_2}-\underset{3}{CH_2}-\underset{4}{CH_2}-\underset{5}{CH_2}-(CH_2)_{10}-\underset{5}{CH_2}-\underset{4}{CH_2}-\underset{3}{CH_2}-\underset{2}{CH_2}-\underset{1}{CH_3}$$

The intermediate oil isomerates are intermediate products of the process to make the lubricant base oils of the present invention. The intermediate oil isomerates are produced by subjecting a waxy feed to a mild hydroisomerization process using a specific class of shape selective catalysts that impart a large degree of pour point reduction with a minimum degree of branching. The intermediate oil isomerates are solvent dewaxed to provide the lubricant base oils of the present invention.

According to the present invention, the intermediate oil isomerates comprise paraffinic hydrocarbon components having specific branching properties. The intermediate oil isomerates are comprised of paraffinic hydrocarbon components having low amounts of branching overall. In particular, the intermediate oil isomerates comprise paraffinic hydrocarbon components having less than 7.0 alkyl branches per 100 carbons and preferably less than less than 6.5 alkyl branches per 100 carbons.

The intermediate oil isomerates are solvent dewaxed to provide the lubricant base oils of the present invention. According to the present invention, the lubricant base oils comprise paraffinic hydrocarbon components in which the branching is optimized. The lubricant base oils comprise paraffinic hydrocarbon components having optimized branching in that the paraffinic hydrocarbon components of the isomerates have low amounts of branching overall with the branching concentrated toward the center of the molecules.

In particular, the lubricant base oils comprise paraffinic hydrocarbon components having less than 8 alkyl branches per 100 carbons, preferably less than 7 alkyl branches per 100 carbons, and more preferably less than 6.5 alkyl branches per 100 carbons. In addition, the lubricant base oils comprise paraffinic hydrocarbon components having less than 20 wt % branching at the two position and preferably less than 15% branching at the two position. The lubricant base oils also have low amounts of branching at the two plus three positions, preferably less than 25 wt % and more preferably less than 20 wt %. Furthermore, the lubricant base oils have branching at the five or greater positions of greater than 45 wt % and more preferably greater than 50 wt %.

It is generally accepted in the art that it is easier to produce lubricant base oils with low kinematic viscosities, generally less than about 3.2 cSt at 100° C., and having low pour points, than it is to produce lubricant base oils with higher kinematic viscosities, which also have desirable pour points. The paraffinic hydrocarbon molecules comprising lubricant base oils of low kinematic viscosities are of relatively shorter paraffinic chains, generally less than about 25 carbons in length. Since lubricant base oils having relatively low kinematic viscosities are of relatively shorter paraffinic chains, these lubricant base oils generally require fewer branches to reach a low pour point.

In contrast, higher viscosity lubricant base oils comprise paraffinic hydrocarbon molecules of longer chain length. In these longer paraffinic hydrocarbon molecules of higher viscosity lubricant base oils, it is much more difficult to isomerize to low amounts of branching and obtain a low pour point.

In addition, it has been previously demonstrated that as branches move toward the middle of linear paraffins for butyl, phenyl, and cyclohexyl branches, the VI declines. Therefore, it would not have been thought desirable to produce a lubricant base oil with branching placement toward the center of the paraffin molecule, and it is quite surprising that doing so, combined with low amounts of branching, provides a lubricant base oil with exceptionally high VI's and low pour points.

According to the processes of the present invention, waxy feeds are processed in such a way as to achieve this desired amount and placement of branching (i.e., optimized branching). Therefore, lubricant base oils with high viscosities, low pour points, and exceptionally high VI's are produced. The lubricant base oils of the present invention have kinematic viscosities at 100° C. greater than about 3.2 cSt, preferably between about 3.2 cSt and about 20 cSt. In addition, the lubricant base oils of the present invention comprise average carbon numbers of greater than about 27, preferably greater than about 30, and more preferably greater than about 27 and less than about 70.

The extent of branching and branching position can be determined by NMR Analysis.

NMR Branching Analysis

The branching properties of the lubricant base oils and intermediate oil isomerates of the present invention are determined by analyzing a sample of oil using carbon-13 NMR according to the following eight-step process. References cited in the description of the process provide details of the process steps. Steps 1 and 2 are performed only on the initial materials from a new process.

1.) Identify the CH branch centers and the $CH_3$ branch termination points using the DEPT Pulse sequence (Doddrell, D. T.; D. T. Pegg; M. R. Bendall, *Journal of Magnetic Resonance* 1982, 48, 323ff.).

2.) Verify the absence of carbons initiating multiple branches (quaternary carbons) using the APT pulse sequence (Patt, S. L.; J. N. Shoolery, *Journal of Magnetic Resonance* 1982, 46, 535ff.).

3.) Assign the various branch carbon resonances to specific branch positions and lengths using tabulated and calculated values (Lindeman, L. P., *Journal of Qualitative Analytical Chemistry* 43, 1971 1245ff; Netzel, D. A., et. al., *Fuel,* 60, 1981, 307ff.).

EXAMPLES

| Branch | NMR Chemical Shift (ppm) |
|---|---|
| 2-methyl | 22.5 |
| 3-methyl | 19.1 or 11.4 |
| 4-methyl | 14.0 |
| 4+ methyl | 19.6 |
| internal ethyl | 10.8 |
| propyl | 14.4 |
| Adjacent methyls | 16.7 |

4.) Quantify the relative frequency of branch occurrence at different carbon positions by comparing the integrated intensity of its terminal methyl carbon to the intensity of a single carbon (=total integral/number of carbons per molecule in the mixture).

For the unique case of the 2-methyl branch, where both the terminal and the branch methyl occur at the same resonance position, the intensity was divided by two before doing the frequency of branch occurrence calculation.

If the 4-methyl branch fraction is calculated and tabulated, its contribution to the 4+ methyls must be subtracted to avoid double counting.

5.) Calculate the Free Carbon Index using the calculated average carbon number of the sample and the results from the C-13 NMR analysis, as described in EP 1062305. The Free Carbon Index (FCI) is a measure of the number of carbon atoms in an isoparaffin that are located at least 5 carbons from a terminal carbon and 4 carbons away from a side chain. The average carbon number may be determined with sufficient accuracy for lubricant materials by dividing the molecular weight of the sample by 14 (the formula weight of $CH_2$). Molecular weight may be determined by ASTM D2502, ASTM D2503, or other suitable method. According to the present invention, molecular weight is preferably determined by ASTM D2503-02.

6.) Calculate the Branching Index (BI) and Branching Proximity (BP) using the calculations described in U.S. Pat. No. 6,090,989. Branching Index is the ratio in percent of non-benzylic methyl hydrogens in the range of 0.5 to 1.05 ppm, to the total non-benzylic aliphatic hydrogens in the range of 0.5 to 2.1 ppm. The Branching Proximity is the % equivalent recurring methylene carbons, which are five or more removed from an end group or branch (epsilon carbons).

7.) The number of branches per molecule is the sum of the branches found in step 4.

8.) The number of alkyl branches per 100 carbon atoms is calculated from the number of branches per molecule (step 7) times 100/number of carbons per molecule.

Measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0–80 ppm vs. TMS (tetramethylsilane). Solutions of 15–25% by weight in chloroform-d1 were excited by 45° pulses followed by an 0.8 sec acquisition time. In order to minimize non-uniform intensity data, the proton decoupler was gated off during a 10 sec delay prior to the excitation pulse and on during acquisition. Total experiment times ranged from 11–80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. Both are described in the references cited.

The branching properties of each sample were determined by C-13 NMR using the assumption in the calculations that the entire sample of lubricant base oil or intermediate oil isomerate was iso-paraffinic. Corrections were not made for n-paraffins or naphthenes, which may have been present in the oil samples in varying amounts. The % total naphthenes in the lubricant base oils were generally low or absent, due to the mild hydroisomerization dewaxing process used in the preparation. The naphthenes content may be measured using Field Ionization Mass Spectroscopy (FIMS).

Feedstock

According to the present invention, the feed to the process to produce lubricant base oils with optimized branching is a waxy hydrocarbon feed. The waxy hydrocarbon feedstocks useful in the processes disclosed herein may be synthetic waxy feedstocks, such as Fischer Tropsch waxy hydrocarbons, or may be derived from natural sources, such as petroleum waxes. Accordingly, the waxy feedstocks to the processes may comprise Fischer Tropsch derived waxy feeds, petroleum waxes, waxy distillate stocks such as gas oils, lubricant oil stocks, high pour point polyalphaolefins, foots oils, normal alpha olefin waxes, slack waxes, deoiled waxes, and microcrystalline waxes, and mixtures thereof. Preferably, the waxy feedstocks are derived from Fischer Tropsch waxy feeds. A substantial proportion of the waxy feed comprises molecules with a carbon number of $C_{20+}$ and has a boiling point generally above about 600° F. (316° C.). The majority of the molecules in the waxy feed are higher molecular weight n-paraffins and slightly branched paraffins which contribute to the waxy nature of the feed.

The waxy hydrocarbon feedstock may be hydrotreated prior to the process as described herein if desired.

Fischer-Tropsch Synthesis

Preferably, the waxy feedstocks of the present invention are derived from Fischer Tropsch waxy feeds. In Fischer-Tropsch chemistry, syngas is converted to liquid hydrocarbons by contact with a Fischer-Tropsch catalyst under reactive conditions. Typically, methane and optionally heavier hydrocarbons (ethane and heavier) can be sent through a conventional syngas generator to provide synthesis gas. Generally, synthesis gas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason and depending on the quality of the syngas, it is preferred to remove sulfur and other contaminants from the feed before performing the Fischer-Tropsch chemistry. Means for removing these contaminants are well known to those of skill in the art. For example, ZnO guardbeds are preferred for removing sulfur impurities. Means for removing other contaminants are well known to those of skill in the art. It also may be desirable to purify the syngas prior to the Fischer-Tropsch reactor to remove carbon dioxide produced during the syngas reaction and any additional sulfur compounds not already removed. This can be accomplished, for example, by contacting the syngas with a mildly alkaline solution (e.g., aqueous potassium carbonate) in a packed column.

In the Fischer-Tropsch process, contacting a synthesis gas comprising a mixture of $H_2$ and CO with a Fischer-Tropsch catalyst under suitable temperature and pressure reactive conditions forms liquid and gaseous hydrocarbons. The Fischer-Tropsch reaction is typically conducted at temperatures of about 300–700° F. (149–371° C.), preferably about 400–550° F. (204–228° C.); pressures of about 10–600 psia, (0.7–41 bars), preferably about 30–300 psia, (2–21 bars); and catalyst space velocities of about 100–10,000 cc/g/hr, preferably about 300–3,000 cc/g/hr. Examples of conditions for performing Fischer-Tropsch type reactions are well known to those of skill in the art.

The products of the Fischer-Tropsch synthesis process may range from $C_1$ to $C_{200+}$ with a majority in the $C_5$ to $C_{100+}$ range. The reaction can be conducted in a variety of reactor types, such as fixed bed reactors containing one or more catalyst beds, slurry reactors, fluidized bed reactors, or a combination of different type reactors. Such reaction processes and reactors are well known and documented in the literature.

The slurry Fischer-Tropsch process, which is preferred in the practice of the invention, utilizes superior heat (and mass) transfer characteristics for the strongly exothermic synthesis reaction and is able to produce relatively high molecular weight, paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP0609079, also completely incorporated herein by reference for all purposes.

In general, Fischer-Tropsch catalysts contain a Group VIII transition metal on a metal oxide support. The catalysts may also contain a noble metal promoter(s) and/or crystalline molecular sieves. Suitable Fischer-Tropsch catalysts comprise one or more of Fe, Ni, Co, Ru and Re, with cobalt being preferred. A preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Certain catalysts are known to provide chain growth probabilities that are relatively low to moderate, and the reaction products include a relatively high proportion of low molecular ($C_{2-8}$) weight olefins and a relatively low proportion of high molecular weight ($C_{30+}$) waxes. Certain other catalysts are known to provide relatively high chain growth probabilities, and the reaction products include a relatively low proportion of low molecular ($C_{2-8}$) weight olefins and a relatively high proportion of high molecular weight ($C_{30}$+) waxes. Such catalysts are well known to those of skill in the art and can be readily obtained and/or prepared.

The product from a Fischer-Tropsch process contains predominantly paraffins. The products from Fischer-Tropsch reactions generally include a light reaction product and a waxy reaction product. The light reaction product (i.e., the condensate fraction) includes hydrocarbons boiling below about 700° F. (e.g., tail gases through middle distillate fuels), largely in the $C_5$–$C_{20}$ range, with decreasing amounts up to about $C_{30}$. The waxy reaction product (i.e., the wax fraction) includes hydrocarbons boiling above about 600° F. (e.g., vacuum gas oil through heavy paraffins), largely in the $C_{20+}$ range, with decreasing amounts down to $C_{10}$.

Both the light reaction product and the waxy product are substantially paraffinic. The waxy product generally comprises greater than 70 weight % normal paraffins, and often greater than 80 weight % normal paraffins. The light reaction product comprises paraffinic products with a significant proportion of alcohols and olefins. In some cases, the light reaction product may comprise as much as 50 weight %, and even higher, alcohols and olefins. It is the waxy reaction product (i.e., the wax fraction) that may be used as a feedstock for the processes of the present invention.

Hydroisomerization

According to the present invention, the waxy hydrocarbon feedstock is subjected to hydroisomerization in a hydroisomerization zone, producing an intermediate oil isomerate.

Hydroisomerization is intended to improve the cold flow properties of a lubricant base oil by the selective addition of branching into the molecular structure. Hydroisomerization dewaxing ideally will achieve high conversion levels of waxy feed to non-waxy iso-paraffins while at the same time minimizing the conversion by cracking.

According to the present invention, hydroisomerization is conducted using a shape selective intermediate pore size molecular sieve. Hydroisomerization catalysts useful in the present invention comprise a shape selective intermediate pore size molecular sieve and optionally a catalytically active metal hydrogenation component on a refractory oxide support. The phrase "intermediate pore size," as used herein means an effective pore aperture in the range of from about 4.0 to about 7.1 Å when the porous inorganic oxide is in the calcined form. The shape selective intermediate pore size molecular sieves used in the practice of the present invention are generally 1-D 10-, 11- or 12-ring molecular sieves. The preferred molecular sieves of the invention are of the 1-D 10-ring variety, where 10-(or 11-or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization are zeolites, such as ZSM-22, ZSM-23, ZSM-35, ZSM-48, ZSM-57, SSZ-32, offretite, and ferrierite. SSZ-32 and ZSM-23 are more preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 4.0 to about 7.1 Angstrom, having a maximum crystallographic free diameter of not more than 7.1 and a minimum crystallographic free diameter of not less than 3.9 Angstrom. Preferably the maximum crystallographic free diameter is not more than 7.1 and the minimum crystallographic free diameter is not less than 4.0 Angstrom. Most preferably the maximum crystallographic free diameter is not more than 6.5 and the minimum crystallographic free diameter is not less than 4.0 Angstrom. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10–15, which is incorporated herein by reference.

A particularly preferred intermediate pore size molecular sieve, which is useful in the present process is described, for example, in U.S. Pat. No. 5,135,638 and 5,282,958, the contents of which are hereby incorporated by reference in their entirety. In U.S. Pat. No. 5,282,958, such an intermediate pore size molecular sieve has a crystallite size of no more than about 0.5 microns and pores with a minimum diameter of at least about 4.8 Å and with a maximum diameter of about 7.1 Å. The catalyst has sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40 percent or greater (isomerization selectivity is determined as follows: 100×(weight % branched $C_{16}$ in product)/(weight % branched $C_{16}$ in product+weight % $C_{13-}$ in product) when used under conditions leading to 96% conversion of normal hexadecane (n-$C_{16}$) to other species.

Such a particularly preferred molecular sieve may further be characterized by pores or channels having a crystallographic free diameter in the range of from about 4.0 to about 7.1 Å, and preferably in the range of 4.0 to 6.5 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10–15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes (p/po=0.5; 25° C.). Intermediate pore size molecular sieves will typically admit molecules having kinetic diameters of 5.3 to 6.5 Angstrom with little hindrance.

Hydroisomerization catalysts useful in the present invention optionally comprise a catalytically active hydrogenation metal. The presence of a catalytically active hydrogenation metal leads to product improvement, especially VI and stability. Typical catalytically active hydrogenation metals include chromium, molybdenum, nickel, vanadium, cobalt, tungsten, zinc, platinum, and palladium. The metals platinum and palladium are especially preferred, with platinum most especially preferred. If platinum and/or palladium is used, the total amount of active hydrogenation metal is typically in the range of 0.1 to 5 weight percent of the total catalyst, usually from 0.1 to 2 weight percent, and not to exceed 10 weight percent.

The refractory oxide support may be selected from those oxide supports, which are conventionally used for catalysts, including silica, alumina, silica-alumina, magnesia, titania and combinations thereof.

The conditions for hydroisomerization will be tailored to achieve an isomerized oil intermediate with specific branching properties, as described above, and thus will depend on the characteristics of feed used. In general, conditions for hydroisomerization in the present invention are mild such that the conversion of wax to materials boiling below about 700° F. is maintained below about 35 wt % in producing the intermediate oil isomerates.

Mild hydroisomerization conditions are achieved through operating at a lower temperature, generally between about 390° F. and 650° F. at a LHSV generally between about 0.5 $hr^{-1}$ and about 20 $hr^{-1}$. The pressure is typically from about 15 psig to about 2500 psig, preferably from about 50 psig to about 2000 psig, more preferably from about 100 psig to about 1500 psig. Low pressure provides enhanced isomerization selectivity, which results in more isomerization and less cracking of the feed, thus producing an increased yield.

Hydrogen is present in the reaction zone during the hydroisomerization process, typically in a hydrogen to feed ratio from about 0.5 to 30 MSCF/bbl (thousand standard cubic feet per barrel), preferably from about 1 to about 10 MSCF/bbl. Hydrogen may be separated from the product and recycled to the reaction zone.

These mild hydroisomerization conditions using the shape selective intermediate pore size molecular sieves produce intermediate oil isomerates comprising paraffinic hydrocarbon components having specific branching properties, i.e., having low amounts of branching overall.

As described above, the intermediate oil isomerates have less than 7.0, preferably less than 6.5 alkyl branches per 100 carbons, as determined by NMR branching analysis.

Solvent Dewaxing

According to the present invention, the intermediate oil isomerates are subjected to solvent dewaxing, producing lubricant base oils comprising paraffinic hydrocarbon components with optimized branching properties. Therefore, the solvent dewaxing produces lubricant base oils comprising paraffinic hydrocarbon components having low amounts of branching overall with branching concentrated toward the center of the molecules.

Solvent dewaxing is used to remove the remaining waxy molecules from the intermediate oil isomerate by dissolving the intermediate oil isomerate in a solvent, such as methyl ethyl ketone, methyl iso-butyl ketone, or toluene, or precipitating the wax molecules as discussed in Chemical Technology of Petroleum, 3rd Edition, William Gruse and Donald Stevens, McGraw-Hill Book Company, Inc., New York, 1960, pages 566 to 570. See also U.S. Pat. Nos. 4,477,333, 3,773,650 and 3,775,288. In the present invention solvent dewaxing is advantageously used following hydroisomerization to recover unconverted wax following hydroisomerization at mild conditions where conversions of the wax to material boiling below about 700° F. is less than about 35%.

According to the present invention, the solvent dewaxing may be conducted by conventional processes well known to those of skill in the art. Solvent dewaxing may be accomplished by cooling intermediate oil isomerate/solvent admixtures under controlled conditions for crystallization of the paraffinic wax present in the admixtures. In such processes, the intermediate oil isomerate and dewaxing solvent, are heated to a temperature at which the wax is dissolved. The heated charge is then passed into a cooling zone wherein cooling is undertaken at a uniform slow rate in the range of about 0.5° to 4.5° C./min until a temperature is reached (e.g. −10° to −20° C.) at which a substantial portion of the wax is crystallized and the dewaxed lubricant base oil product has a selected pour point temperature. Upon achieving the desired dewaxing temperature, the mixture of wax crystals, intermediate oil isomerate, and solvent is subjected to solid-liquid separation for recovery of a wax free oil-solvent solution and a solid wax containing a minor proportion of oil. Solid-liquid separation techniques, which may be employed for separation of wax crystals from the oil-solvent solutions, include known solid-liquid separation processes, such as gravity settling, centrifugation, and filtration. Most commonly, in commercial processes, filtration in a rotary vacuum filter, followed by solvent wash of the wax cake, is employed. The solid wax/oil solution obtained after separation of the solid wax is known as slack wax.

The separated oil-solvent solution is subjected to distillation for recovery of a solvent fraction and a dewaxed lubricant base oil product fraction. This process is as described in U.S. Pat. No. 5,413,695, the contents of which are incorporated by reference in their entirety.

Solvents known to be useful as dewaxing solvents are ketones containing 3 to 6 carbon atoms, for example, acetone, methylethyl ketone (MEK), and methylisobutylketone (MIBK), mixtures of ketones, and mixtures of ketones with aromatic hydrocarbons including benzene and toluene. Halogenated low molecular weight hydrocarbons, including dichloromethane and dichloroethane, and mixtures thereof are also known dewaxing solvents. Solvent dilution of waxy oil stocks maintains fluidity of the oil for facilitating easy handling, for obtaining optimum wax-oil separation, and for obtaining optimum dewaxed oil yields. The extent of solvent dilution depends upon the particular intermediate oil isomerate stocks and solvents used, the approach to filtration temperature in the cooling zone, and the desired final ratio of solvent to oil in the separation zone.

All or a portion of the wax removed in the dewaxing step may be recovered and recycled to the hydroisomerization step for use in the process of the present invention and/or collected for other uses (e.g., for processing into or use as salable wax). When recycling all or a portion of the recovered wax, the wax may be subjected to the hydroisomerization step of the present invention alone or may be combined with another waxy feedstock. Recycling all or a portion of the recovered wax increases the yield of the process.

After solvent dewaxing, a lubricant base oil comprising paraffinic hydrocarbon components with optimized branching is provided. Optimized branching means that the lubricant base oil comprises paraffinic hydrocarbon components having low amounts of branching overall with the branching concentrated toward the center of the molecules. The lubricant base oils comprising paraffinic hydrocarbon components with optimized branching recovered from the process of the present invention have a kinematic viscosity at 100° C. of greater than about 3.2 cSt. In addition, the lubricant base oils comprising paraffinic hydrocarbon components having optimized branching have Viscosity Indexes greater than the Target Viscosity Indexes of the oil, as defined above. Preferably, the viscosity indexes of the lubricant base oils of the present invention are greater than the Target Viscosity Index of the oil plus 5. The lubricant base oils also have a pour point of less than −8° C., preferably less than −9° C., more preferably ≦−15° C., and even more preferably less than −15° C.

Generally the difference in pour points between the pour point of the lubricant base oil and the intermediate oil isomerate prior to solvent dewaxing is greater than about 25° F.

Hydrofinishing

The lubricant base oil comprising paraffinic hydrocarbon components with optimized branching, or optionally the intermediate oil isomerate, may be hydrofinished in order to improve product quality and stability. During hydrofinishing, overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

Suitable hydrofinishing catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. No. 4,157,294, and U.S. Pat. No. 3,904,513. The non-noble metal (such as nickel-molybdenum and/or tungsten, and at least about 0.5, and generally about 1 to about 15 weight percent of nickel and/or cobalt determined as the corresponding oxides. The noble metal (such as platinum) catalyst contains in excess of 0.01 percent metal, preferably between 0.1 and 1.0 percent metal. Combinations of noble metals may also be used, such as mixtures of platinum and palladium.

Lubricant Base Oils with Optimized Branching

The lubricant base oils of the present invention comprise paraffinic hydrocarbon components in which the branching is optimized. The lubricant base oils comprising paraffinic hydrocarbon components with optimized branching have high viscosities, low pour points, and exceptionally high VI's. The lubricant base oils of the present invention have kinematic viscosities at 100° C. greater than about 3.2 cSt, preferably between about 3.2 cSt and about 20 cSt. In addition, the lubricant base oils of the present invention comprise paraffinic hydrocarbon components having average carbon numbers of greater than about 27, preferably greater than about 30, and more preferably greater than about 27 and less than about 70.

The American Petroleum Institute (API) has classified base oils according to their chemical composition. As defined by the API, Group III oils are very high viscosity index oils (>120) having a total sulfur content less than 300 ppm and a saturates content of greater than or equal to 90%. API Group III oils also are traditionally manufactured by severe hydrocracking and or wax isomerization. Lubricant base oils of the present invention are generally classified as API Group III base oils. When they are made from waxy feeds with a low total sulfur content, such as a Fischer-Tropsch feeds, the lubricant base oils will also have a total sulfur content less than 300 ppm.

Lubricant base oils according to the present invention made from Fischer-Tropsch waxy feeds generally have total sulfur contents of less than about 5 ppm, saturates contents of greater than 95%, and total naphthene contents of between zero and about 8%, and preferably between zero and about 5%. Total sulfur is determined using ultraviolet fluorescence by ASTM D 5453-00.

In particular, the lubricant base oils comprise paraffinic hydrocarbon components having less than 8 alkyl branches per 100 carbons, preferably less than 7 alkyl branches per 100 carbons, and more preferably less than 6.5 alkyl branches per 100 carbons. The branching at the two position, as determined by NMR branching analysis, is less than 20 wt %, preferably less than 15 wt %. The branching at the two plus three positions is less than 25 wt %, preferably less than 20 wt %. In addition the branching at the five or greater positions is greater than 50 wt %, preferably greater than 60 wt %. The free carbon indexes of the lubricant base oils of the present invention are generally greater than about 3, and preferably greater than about 5.

The lubricant base oils of the present invention comprise paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2$>4), are such that BI−0.5($CH_2$>4) is less than 12, while retaining low pour points. Preferably, the lubricant base oils of the present invention have branching such that the BI−0.5BP is less than 10, more preferably less than 8, and even more preferably less than 6, while retaining low pour points.

Pour point is the temperature at which a sample of the lubricant base oil will begin to flow under carefully controlled conditions. Where pour point is given herein, unless stated otherwise, it has been determined by standard analytical method ASTM D 5950-02. The lubricant base oils with optimized branching according to the present invention have excellent pour points. The pour points of the lubricant base oils are less than −8° C., preferably less than −9° C., more preferably ≦−15° C., and even more preferably less than −15° C.

Cloud point is a measurement complementary to the pour point, and is expressed as a temperature at which a sample of the lubricant base oil begins to develop a haze under carefully specified conditions. Cloud point may be determined by, for example, ASTM D 5773-95. The lubricant base oils with optimized branching according to the present invention have cloud points of less than 0° C.

The viscosity indexes of the lubricant base oils comprising paraffinic hydrocarbon components with optimized branching are extremely high and are greater than the Target Viscosity Index of the lubricant base oil, preferably greater than the Target Viscosity Index of the lubricant base oil plus 5. The range of kinematic viscosities of the lubricant base oils with optimized branching are greater than 3.2 cSt at 100° C. and may be between about 3.2 cSt and about 20 cSt at 100° C.

The % total naphthenes in the lubricant base oils are generally low or absent, due to the mild hydroisomerization dewaxing process used in the preparation. Generally, when naphthenes are present, the naphthenes are almost exclusively as mononaphthenes. In the lubricant base oils the total amount of naphthenes present is between zero and about 8 wt % and preferably between zero and about 5 wt %. The naphthenes are measured using Field Ionization Mass Spectroscopy (FIMS), as described in the publication by Kramer, D. C., et al, "Influence of Group II & III Base Oil Composition on VI and Oxidation Stability," prepared for presentation at the 1999 AIChE Spring National Meeting in Houston, Mar. 16, 1999. The percent total naphthenes content of the lubricant base oils of this invention is determined by taking the sum of the % mononaphthenes, % dinaphthenes, % trinaphthenes, % tetranaphthenes, % pentanaphthenes, and % hexanaphthenes measured by FIMS for each sample.

Since the lubricant base oils of the present invention have extremely low amounts of aromatics and multi-ring naphthenes, the lubricant base oils have superior oxidation stability. One way to measure the oxidation stability of lubricant base oils is the Oxidator BN test, as described by U.S. Pat. No. 3,852,207. The Oxidator BN test measures the resistance to oxidation by means of a Dornte-type oxygen absorption apparatus. R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of $O_2$ by 100 g of oil. In the Oxidator BN test, 0.8 ml of catalyst is used per 100 grams of oil and an additive package is included in the oil to be tested. The catalyst is a mixture of soluble metal-naphthenates in kerosene simulating the average metal analysis of used crankcase oil. The concentrations of the metals in the catalyst are as follows: Copper=6,927 ppm; Iron=4,083 ppm; Lead=80,208 ppm; Manganese=350 ppm; and Tin=3565 ppm. The additive package is 80 millimoles of zinc bispolypropylenephenyldithiophosphate per 100 grams of oil to be tested. Oxidator BN measures the response of a lubricant base oil in a simulated application. High values, or long times to absorb one liter of oxygen, indicate good oxidation stability. For general use, it is desired that the Oxidator BN of a lubricant base oil be above 7 hours. For the lubricant base oils of the present invention, the Oxidator BN value is greater than about 15 hours, preferably greater than about 30 hours.

Blends

The lubricant base oils of the present invention may be used alone or may be blended with additional base oils selected from the group consisting of conventional Group I base oils, conventional Group II base oils, conventional Group III base oils, isomerized petroleum wax, polyalphaolefins (PAO), poly internal olefins (PIO), diesters, polyol esters, phosphate esters, alkylated aromatics, and mixtures thereof.

Alkylated aromatics are synthetic lubricants produced from the alkylation of aromatics with haloalkanes, alcohols, or olefins in the presence of a Lewis or Bronstead acid catalyst. An overview of alkylated aromatic lubricants is given in Synthetic Lubricants and High-Performance Functional Fluids, edited by Ronald L. Shubkin, 1993, pp 125–144, incorporated herein. Useful examples of alkylated aromatics are alkylated naphthalene and alkylated benzene. Alkylated aromatics have good low temperature properties, and may provide improved additive solubility and performance in blends with other base oils.

Since the lubricant base oils of the present invention have excellent cold flow properties, high VI's, and high oxidation stability, they are ideal blending stocks for upgrading conventional lubricant base oils.

It is preferred that when the lubricant base oils of the present invention are blended with one or more additional lubricant base oils, the additional base oils be present in an amount of less than 95 wt % of the total resultant base oil composition.

Finished Lubricants

Lubricant base oils are the most important component of finished lubricants, generally comprising greater than 70% of the finished lubricants. Finished lubricants comprise a lubricant base oil and at least one additive. Finished lubricants may be used in automobiles, diesel engines, axles, transmissions, and industrial applications. Finished lubricants must meet the specifications for their intended application as defined by the concerned governing organization.

The lubricant base oils of the present invention are useful in commercial finished lubricants. As a result of their excellent VI's and low temperature properties, the lubricant base oils of the present invention are suitable for formulating finished lubricants intended for many of these applications. In addition, the excellent oxidation stability of the lubricant base oils of the present invention makes them useful in finished lubricants for many high temperature applications.

Additives, which may be blended with the lubricant base oil of the present invention, to provide a finished lubricant composition include those which are intended to improve select properties of the finished lubricant. Typical additives include, for example, anti-wear additives, EP agents, detergents, dispersants, antioxidants, pour point depressants, VI improvers, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fluid-loss additives, colorants, and the like.

Other hydrocarbons, such as those described in U.S. Pat. Nos. 5,096,883 and 5,189,012, may be blended with the lubricant base oil provided that the finished lubricant has the necessary pour point, kinematic viscosity, flash point, and toxicity properties. These other hydrocarbons include base oils particularly useful in drilling fluids. By way of example, U.S. Pat. No. 5,096,883 relates to a substantially non-toxic base oil that consists essentially of branched-chain paraffins or branched-chain paraffins substituted with an ester functionality, or mixtures thereof, the base-oil preferably having between about 18 and about 40 carbon atoms per molecule and, more preferably, between about 18 and about 32 carbon atoms per molecule. U.S. Pat. No. 5,189,012 relates to synthetic hydrocarbons selected from the group consisting of branched chain oligomers synthesized from one or more olefins containing a $C_2$ to $C_{14}$ chain length and wherein the oligomers have an average molecular weight of from 120 to 1000.

Typically, the total amount of additives in the finished lubricant will be approximately 1 to about 30 weight percent of the finished lubricant. However, since the lubricant base oils of the present invention have excellent properties including low pour point, high VI's, and excellent oxidative stability, a lower amount of additives may be required to meet the specifications for the finished lubricant than is typically required with base oils made by other processes. The use of additives in formulating finished lubricants is well documented in the literature and well known to those of skill in the art.

EXAMPLES

The invention will be further explained by the following illustrative examples that are intended to be non-limiting.

All simulated distillation boiling range distributions in this disclosure are measured using the standard analytical method D 6352-98 or its equivalent unless stated otherwise. As used herein, an equivalent analytical method to D 6352-98 refers to any analytical method, which gives substantially the same results as the standard method.

Example 1

Example 1 produced a lubricant base oil made from n-$C_{28}$ feed (purchased from Aldrich) using a Pt/SSZ-32 catalyst (0.3 wt % Pt) bound with 35 wt % Catapal alumina. The run was at 1000 psig, 0.8 LHSV, and 7 MSCF/bbl once-through $H_2$. Reactor temperature was 575° F. The effluent from the reactor was subsequently passed over a Pt—Pd/$SiO_2$—$Al_2O_3$ hydrofinishing catalyst at 450° F. and, other than temperature, the same conditions were used as in the isomerization reactor. The yield of 600° F.+ product was 71.5 wt %. The conversion of the wax to 600° F.− boiling range material was 28.5 wt %. The conversion below 700° F. was 33.6 wt %. The bottoms fraction from the run (75.2 wt %) was cut at 743° F. to give 89.2 wt % bottoms (67.1 wt % on the whole feed). The properties of the hydroisomerized oil bottoms are summarized below in Table I:

TABLE I

| Hydroisomerized Oil Bottoms Properties | |
|---|---|
| Pour Point, ° C. | +3 |
| NMR Analysis | |
| C2 Branch | 0.26 |
| C3 Branch | 0.2 |
| C4 Branch | 0.26 |
| C5+ Branch | 0.97 |
| Internal Ethyl | 0.09 |
| Sum | 1.78 |
| NMR Branching Properties | |
| Alkyl Branches/Molecule | 1.78 |
| Alkyl Branches/100 Carbons | 6.14 |
| Percent Branching at Two Position | 14.6 |
| Percent Branching at Two Plus Three Positions | 25.8 |
| Percent Branching at the Five or Greater Positions | 54.5 |

These bottoms were then solvent dewaxed at −15° C. to give 84.2 wt % solvent dewaxed oil (56.5 wt % on the whole feed), and 15.7 wt % wax. Evaluations of the properties of the oil are summarized below in Table VI.

Example 2

An n-$C_{36}$ feed (purchased from Aldrich) was isomerized over a Pt/SSZ-32 catalyst which contained 0.3% Pt and 35% Catapal alumina binder. Run conditions were 580° F., 1.0 LHSV, 1000 psig reactor pressure, and a once-through hydrogen rate of 7 MSCF/bbl. The reactor effluent passed directly to a second reactor, also at 1000 psig, which contained a Pt/Pd on silica-alumina hydrofinishing catalyst. Conditions in that reactor were a temperature of 450° F. and LHSV of 1.0. Conversion and yields were as summarized below in Table II:

TABLE II

| | |
|---|---|
| Conversion <650° F., Wt % | 32.2 |
| Conversion <700° F., Wt % | 34.4 |
| Yields, Wt % | |
| C1–C2 | 0.45 |
| C3–C4 | 5.16 |
| C5–180° F. | 6.22 |
| 180–350° F. | 7.40 |
| 350–650° F. | 13.23 |
| 650° F.+ | 68.09 |

The bottoms fraction from the run was isolated. The properties of the hydroisomerized oil bottoms are summarized below in Table IIII:

TABLE III

| Hydroisomerized Stripper Bottoms Properties Sim. Dist., LV %, ° F. | |
|---|---|
| IBP/5 | 677/747 |
| 10/30 | 801/904 |
| 50 | 914 |
| 70/90 | 920/925 |
| 95/FBP | 927/929 |
| Pour Point, ° C. | +20 |

The stripper bottoms were solvent dewaxed using methyl-ethyl ketone (MEK)/toluene at −15° C. The wax content was 31.5 wt %, and oil yield was 68.2 wt %. The solvent dewaxed 650° F.+ oil yield, based on feed to the process, was 45.4 wt %. Evaluations of the properties of the oil are summarized below in Table VI.

Example 3

A hydrotreated Fischer-Tropsch wax was isomerized over a Pt/SSZ-32 catalyst, which contained 0.3% Pt and 35% Catapal alumina binder. Run conditions were 560° F., 1.0 LHSV, 300 psig reactor pressure, and a once-through hydrogen rate of 6 MSCF/bbl. The reactor effluent passed directly to a second reactor, also at 300 psig, which contained a Pt/Pd on silica-alumina hydrofinishing catalyst. Conditions in that reactor were a temperature of 450° F. and LHSV of 1.0. Properties of the hydrotreated Fischer-Tropsch wax are summarized below in Table IV. Conversion and yields, as well as the properties of the hydroisomerized stripper bottoms are summarized below in Table V.

TABLE IV

| Inspections of Hydrotreated Fischer-Tropsch Wax (951-15-431) | |
|---|---|
| Gravity, API | 40.3 |
| Nitrogen, ppm | 1.6 |
| Total sulfur, ppm | 2 |
| Sim. Dist., Wt %, ° F. | |
| IBP/5 | 512/591 |
| 10/30 | 637/708 |
| 50 | 764 |
| 70/90 | 827/911 |
| 95/FBP | 941/1047 |

TABLE V

| Isomerization of FT Wax over Pt/SSZ-32 at 560° F., 1 LHSV, 300 psig, and 6 MSCF/bbl H2 | |
|---|---|
| Conversion <650° F., Wt % | 15.9 |
| Conversion <700° F., Wt % | 14.1 |
| Yields, Wt % | |
| C1–C2 | 0.11 |
| C3–C4 | 1.44 |
| C5–180° F. | 1.89 |
| 180–290° F. | 2.13 |
| 290–650° F. | 21.62 |
| 650° F.+ | 73.19 |
| Stripper Bottoms: | |
| Yield, Wt % of Feed | 75.9 |

TABLE V-continued

| Isomerization of FT Wax over Pt/SSZ-32 at 560° F., 1 LHSV, 300 psig, and 6 MSCF/bbl H2 | |
|---|---|
| Sim. Dist., LV %, ° F. | |
| IBP/5 | 588/662 |
| 30/50 | 779/838 |
| 95/99 | 1070/1142 |
| Pour Point, ° C. | +25 |
| NMR Analysis: | |
| C2 Branch | 0.28 |
| C3 Branch | 0.23 |
| C4 Branch | 0.26 |
| C5+ Branch | 1.00 |
| Internal Ethyl | 0.11 |
| Sum | 1.88 |
| NMR Branching Properties: | |
| Alkyl Branches/Molecule | 1.88 |
| Alkyl Branches/100 Carbons | 6.21 |
| Percent Branching at Two Position | 14.9 |
| Percent Branching at Two Plus Three Positions | 27.1 |
| Percent Branching at Five or Greater Positions | 53.2 |

The stripper bottoms were solvent dewaxed using MEK/toluene at −15° C. The wax content was 33.9 wt %, and oil yield was 65.7 wt %. The solvent dewaxed 650° F.+ oil yield, based on feed to the process, was 49.9 wt %. Evaluations of the properties of the oil are summarized below in Table VI.

TABLE VI

| Properties of Hydroisomerized Wax after Solvent Dewaxing | Example 1 | Example 2 | Example 3 |
|---|---|---|---|
| NMR Analysis | | | |
| C2 Branch | 0.24 | 0.27 | 0.27 |
| C3 Branch | 0.14 | 0.22 | 0.18 |
| C4 Branch | 0.18 | 0.23 | 0.21 |
| C5+ Branch | 1.12 | 1.75 | 1.1 |
| Internal Ethyl | 0.07 | 0.13 | 0.1 |
| Sum | 1.75 | 2.60 | 1.86 |
| Branching Index (BI) | 19.7 | 18.8 | 19 |
| Branching Proximity (BP) | 28.5 | 29.6 | 28.1 |
| Alkyl Branches per Molecule | 1.68 | 2.47 | 1.76 |
| BI-0.5 BP | 5.45 | 4.00 | 4.95 |
| Free Carbon Index (FCI) | 7.90 | 11.00 | 7.70 |
| Alkyl Branches per 100 Carbons | 6.04 | 6.66 | 6.42 |
| Percent of Branching at the 2 Position | 13.7 | 10.4 | 14.5 |
| Percent of Branching at the 2 + 3 Positions | 21.7 | 18.8 | 24.2 |
| Percent of Branching at the 5 or Greater Positions | 64.0 | 67.3 | 59.1 |
| Viscosity Index | 165 | 182 | 175 |
| Viscosity at 100° C. | 3.447 | 5.488 | 3.776 |
| Viscosity at 40° C. | 12.43 | 23.62 | 13.90 |
| Pour Point, ° C. | −15 | −9 | −18 |

TABLE VI-continued

| Properties of Hydroisomerized Wax after Solvent Dewaxing | Example 1 | Example 2 | Example 3 |
|---|---|---|---|
| Cloud Point, ° C. | −4 | −3 | −5 |
| Average Carbon Number | 27.8 | 37.1 | 27.4 |
| Sim. Dist., LV %, ° F. | | | |
| IBP/5 | | 683/748 | 608/652 |
| 10/30 | | 792/902 | 670/718 |
| 50 | | 912 | 775 |
| 70/90 | | 919/923 | 890/953 |
| 95/FBP | | 924/926 | 1004/1116 |
| FIMS Analysis | | | |
| % Paraffins | 100 | 98 | 96 |
| % Mononaphthenes | 0 | 1.7 | 4 |
| % Dinaphthenes | 0 | 0 | 0 |
| % Trinaphthenes | 0 | 0 | 0 |
| % Tetranaphthenes | 0 | 0 | 0 |
| % Pentanaphthenes | 0 | 0 | 0 |
| % Hexanaphthenes | 0 | 0 | 0 |
| Total | 100 | 99.7 | 100 |
| Oxidator BN, Hours | | | 31.87 |

Various modifications and alterations of this invention will become apparent to those skilled in the art without departing from the scope and spirit of this invention. Other objects and advantages will become apparent to those skilled in the art from a review of the preceding description.

What is claimed is:

1. A process of making a lubricant base oil comprising the steps of:

a) hydroisomerization dewaxing a waxy feed using a shape selective intermediate pore size molecular sieve to produce an intermediate oil isomerate, wherein the intermediate oil isomerate comprises paraffinic hydrocarbon components in which the extent of branching is less than 7 alkyl branches per 100 carbons;

b) analyzing the intermediate oil isomerate to determine that the intermediate oil isomerate comprises paraffinic hydrocarbon components in which the extent of branching is less than 7 alkyl branches per 100 carbons; and c) solvent dewaxing the intermediate oil isomerate to produce a lubricant base oil wherein the lubricant base oil comprises paraffinic hydrocarbon components in which the extent of branching is less than 8 alkyl branches per 100 carbons and less than 20 wt % of the alkyl branches are at the 2 position; the lubricant base oil having a pour point of less than −8° C.; a kinematic viscosity at 100° C. of about 3.2 cSt or greater; and a Viscosity Index greater than a Target Viscosity Index as calculated by the following equation:

$$\text{Target Viscosity Index}=22\times\ln(\text{Kinematic Viscosity at } 100^\circ\text{ C.})+132.$$

2. The process of claim 1, further comprising providing the waxy feed from a Fischer-Tropsch process.

3. The process of claim 1, wherein the shape selective intermediate pore size molecular sieve is selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof.

4. The process of claim 1, wherein the shape selective intermediate pore size molecular sieve is selected from the group consisting of SAPO-11, SAPO-31, SM-3, SSZ-32, ZSM-23, and combinations thereof.

5. The process of claim 1, wherein the shape selective intermediate pore size molecular sieve comprises a metal hydrogenation component.

6. The process of claim 5, wherein the metal hydrogenation component is platinum, palladium, or mixtures thereof.

7. The process of claim 5, wherein the metal hydrogenation component is platinum.

8. The process of claim 1, further comprising recovering unconverted wax from the solvent dewaxing and recycling the unconverted wax to the hydroisomerization dewaxing.

9. The process of claim 1, further comprising blending the lubricant base oil with an additional base oil selected from the group consisting of conventional Group I base oils, conventional Group II base oils, conventional Group III base oils, isomerized petroleum wax, polyalphaolefins, poly internal olefins, diesters, polyol esters, phosphate esters, alkylated aromatics, and mixtures thereof.

10. The process of claim 1, wherein the intermediate oil isomerate comprises paraffinic hydrocarbon components in which the extent of branching is less than 6.5 alkyl branches per 100 carbons.

11. The process of claim 1, wherein the lubricant base oil has a pour point of less than −9° C.

12. The process of claim 1, wherein the lubricant base oil has a pour point of ≦−15° C.

13. The process of claim 1, wherein the solvent dewaxing lowers the pour point of the intermediate oil isomerate by at least about 25° C. to provide a lubricant base oil with a pour point of at least about 25° C. less than the pour point of the intermediate oil isomerate.

14. The process of claim 1, wherein the lubricant base oil comprises paraffinic hydrocarbon components in which the extent of branching is less than 7 alkyl branches per 100 carbons.

15. The process of claim 1, wherein the lubricant base oil comprises paraffinic hydrocarbon components in which the extent of branching is less than 6.5 alkyl branches per 100 carbons.

16. The process of claim 1, wherein the lubricant base oil comprises paraffinic hydrocarbon components in which less than 25 wt % of the alkyl branches are at the two plus three positions.

17. The process of claim 1, wherein the lubricant base oil comprises paraffinic hydrocarbon components in which greater than 50 wt % of the alkyl branches are at the five or greater positions.

18. The process of claim 1, wherein the lubricant base oil has a Viscosity Index greater than the Target Viscosity Index plus five.

19. The process of claim 1, wherein the lubricant base oil comprises paraffinic hydrocarbon components in which less than 20 wt % of the alkyl branches are at the two plus three positions.

20. The process of claim 1, wherein the lubricant base oil comprises paraffinic hydrocarbon components in which greater than 60 wt % of said alkyl branches are at the five or greater positions.

21. The process of claim 1, wherein the lubricant base oil comprises a naphthene content of less than about 5 wt %.

22. The process of claim 1, wherein the lubricant base oil comprises paraffinic hydrocarbon components in which the extent of branching, as measured by the percentage of methyl hydrocarbons (BI), and the proximity of branching, as measured by the percentage of recurring methylene carbons which are four or more carbons removed from an end group or branch ($CH_2$>4), are such that BI−0.5($CH_2$>4) <12.

23. The process of claim 2, wherein the lubricant base oil comprises a sulfur content of less than about 5 ppm.

24. The process of claim 1, wherein the lubricant base oil has an Oxidator BN value of greater than 25 hours.

25. The process of claim 1, wherein the lubricant base oil comprises paraffinic hydrocarbon components in which the extent of branching is less than 2.5 branches per molecule.

26. The process of claim 1 wherein, the lubricant base oil comprises paraffinic hydrocarbon components in which the extent of branching is less than 2.0 branches per molecule.

27. A process of making a lubricant base oil comprising:

a) performing Fischer-Tropsch synthesis on syngas to provide a product stream;

b) isolating a waxy hydrocarbon feed stream;

c) subjecting the waxy hydrocarbon feed stream to hydroisomerization dewaxing using a shape selective intermediate pore size molecular sieve to form an intermediate oil isomerate, wherein the intermediate oil isomerate comprises paraffinic hydrocarbon components in which the extent of branching is less than 7 alkyl branches per 100 carbons;

d) analyzing the intermediate oil isomerate to determine that the intermediate oil isomerate comprises paraffinic hydrocarbon components in which the extent of branching is less than 7 alkyl branches per 100 carbons; and e) solvent dewaxing the intermediate oil isomerate to produce a lubricant base oil wherein the lubricant base oil comprises paraffinic hydrocarbon components in which the extent of branching is less than 8 alkyl branches per 100 carbons and less than 20 wt % of the alkyl branches are at the 2 position; the lubricant base oil having a pour point of less than −8° C.; a kinematic viscosity at 100° C. of about 3.2 cSt or greater; and a Viscosity Index greater than a Target Viscosity Index as calculated by the following equation:

$$\text{Target Viscosity Index}=22\times\ln(\text{Kinematic Viscosity at } 100^\circ\text{ C.})+132.$$

28. The process of claim 27, further comprising recovering unconverted wax from the solvent dewaxing and recycling the unconverted wax to the hydroisomerization dewaxing.

29. The process of claim 27, further comprising blending the lubricant base oil with an additional base oil selected from the group consisting of conventional Group I base oils, conventional Group II base oils, conventional Group III base oils, isomerized petroleum wax, polyalphaolefins, poly internal olefins, diesters, polyol esters, phosphate esters, alkylated aromatics and mixtures thereof.

30. A process for manufacturing a finished lubricant comprising:

a) hydroisomerization dewaxing a waxy feed using a shape selective intermediate pore size molecular sieve to produce an intermediate oil isomerate, wherein the intermediate oil isomerate comprises paraffinic hydrocarbon components in which the extent of branching is less than 7 alkyl branches per 100 carbons;

b) analyzing the intermediate oil isomerate to determine that the intermediate oil isomerate comprises paraffinic hydrocarbon components in which the extent of branching is less than 7 alkyl branches per 100 carbons;

c) solvent dewaxing the intermediate oil isomerate to produce a lubricant base oil wherein the lubricant base oil comprises paraffinic hydrocarbon components in which the extent of branching is less than 8 alkyl branches per 100 carbons and less than 20 wt % of the alkyl branches are at the 2 position; the lubricant base oil having a pour point of less than −8° C.; a kinematic viscosity at 100° C. of about 3.2 cSt or greater; and a Viscosity Index greater than a Target Viscosity Index as calculated by the following equation:

$$\text{Target Viscosity Index} = 22 \times \ln(\text{Kinematic Viscosity at } 100^\circ\text{ C.}) + 132; \text{ and}$$

d) blending the lubricant base oil with one or more lubricant additives to provide a finished lubricant.

31. The process of claim 30, further comprising providing the waxy feed from a Fischer-Tropsch process.

32. The process of claim 30, further blending the lubricant base oil with an additional base oil selected from the group consisting of conventional Group I base oils, conventional Group II base oils, conventional Group III base oils, isomerized petroleum wax, polyalphaolefins, poly internal olefins, diesters, polyol esters, phosphate esters, alkylated aromatics, and mixtures thereof.

* * * * *